US007665213B2

(12) United States Patent
Pascariello et al.

(10) Patent No.: US 7,665,213 B2
(45) Date of Patent: Feb. 23, 2010

(54) METAL STAMPING PROCESS USING A WIRE PREFORM

(75) Inventors: Anthony Pascariello, Southington, CT (US); William J. Curley, Jr., Waterbury, CT (US); William J. Thurston, Pleasant Valley, NY (US)

(73) Assignee: Illinois Tool Works Inc., Glenview, IL (US)

( * ) Notice: Subject to any disclaimer, the term of this patent is extended or adjusted under 35 U.S.C. 154(b) by 348 days.

(21) Appl. No.: 11/638,782

(22) Filed: Dec. 14, 2006

(65) Prior Publication Data

US 2008/0141750 A1 Jun. 19, 2008

(51) Int. Cl.
*B21D 28/00* (2006.01)

(52) U.S. Cl. ..... 29/899; 29/755; 29/335; 72/337; 72/335; 72/339

(58) Field of Classification Search ..... 29/899, 29/755, 335; 72/337, 335, 339
See application file for complete search history.

(56) References Cited

U.S. PATENT DOCUMENTS

| | | | | |
|---|---|---|---|---|
| 3,719,567 | A * | 3/1973 | Ono et al. | 205/122 |
| 5,729,081 | A * | 3/1998 | Hoffmann et al. | 313/344 |
| 5,848,648 | A * | 12/1998 | Preiss | 168/4 |
| 5,988,967 | A * | 11/1999 | Jones | 411/489 |
| 6,164,965 | A * | 12/2000 | Hammerlund | 433/49 |
| 2003/0219293 | A1 * | 11/2003 | Fujita et al. | 399/381 |
| 2005/0155256 | A1 * | 7/2005 | Santos et al. | 36/134 |
| 2006/0055179 | A1 * | 3/2006 | Burton | 292/216 |

* cited by examiner

*Primary Examiner*—Derris H Banks
*Assistant Examiner*—Dan D Le
(74) *Attorney, Agent, or Firm*—Mark W. Croll; Paul F. Donovan

(57) ABSTRACT

Metal parts can be economically fabricated by a metal stamping that comprises preforming a piece of wire to have a shape corresponding to the 2-dimensional configuration of a desired product workpiece, flattening the wire to form a metal blank, and subjecting the metal blank to metal stamping to obtain the desired product workpiece. The process can significantly reduce the amount of scrap material and thereby reduce manufacturing costs.

19 Claims, 4 Drawing Sheets

METAL STAMPING PROCESS USING A WIRE PREFORM

BACKGROUND OF THE INVENTION

Metal parts are fabricated by a variety processes such as casting, die casting, and forging. One of the more common processes used for manufacturing metal parts is called metal stamping, which has been in use for over 150 years. Metal stamping, which in general involves taking a flat metal sheet and converting into a shaped article (i.e., a metal part) using a die and press, is a cost-effective process because it permits metal parts to be manufactured at high production rates.

In a conventional metal stamping process, a sheet of metal stock material, such as aluminum, copper, zinc, steel, stainless steel, nickel, titanium, or the like, is introduced into a stamping press such as a mechanical or hydraulic stamping press. The stamping press has a die means and a punch means which together are used to form blanks from the initial sheet of stock material. These blanks are then subjected to further stamping procedures to form metal parts. See, e.g., U.S. 2001/0039865 which describes the formation of cylindrical metal blanks having the thickness of the original metal sheet which can then be converted into washers by a piercing process or used as blanks for producing other parts.

A disadvantage of conventional metal stamping processes is that the formation of the blanks from the initial sheet of stock material and the subsequent further processing of the blanks into metal parts can result in generation of excessive amounts of scrap material, thereby adding to the cost of manufacture due to both loss of material and cost of waste disposal.

SUMMARY OF THE INVENTION

Therefore, an aspect of the invention is provide a process of metal stamping which is economical and reduces the costs associated with loss of material and waste disposal. In particular, the invention is directed to a process for manufacturing metal parts or intermediates thereof having a length dimension that is greater than its width dimension, e.g., a length to width ratio of about 1.5:1 to 10:1 or 2:1 to 5:1. The invention is particularly applicable to a metal stamping process using a transfer system wherein a metal workpiece is moved from one tooling station to another by mechanical fingers.

According to the invention there is provided a metal stamping process for forming a metal workpiece comprising:

preforming a piece of wire to have a shape corresponding to the 2-dimensional configuration of a desired product workpiece, flattening the wire to form a metal blank, subjecting the metal blank to metal stamping to obtain the desired product workpiece.

Additionally, according to the invention there is provided a metal stamping process for forming a metal workpiece comprising:

subjecting a metal blank to metal stamping to obtain a desired product workpiece, wherein the metal blank is obtained by preforming a piece of wire to have a shape corresponding to the 2-dimensional configuration as a desired product workpiece, and flattening the wire to form the metal blank.

According to a further aspect of the invention, there is provided a process for manufacturing a metal blank for use in a metal stamping process comprising:

preforming a piece of wire to have a shape corresponding to the 2-dimensional configuration of a desired product workpiece, and flattening the wire to form a metal blank.

Upon further study of the specification and appended claims, further aspects and advantages of this invention will become apparent to those skilled in the art.

In accordance with the inventive process, initially a section of wire is selected and preformed or shaped (e.g., bent) so as to have the same general 2-dimensional configuration as the desired product workpiece. Preferably, the wire is bent to a shape that follows the centerline of the desired product workpiece. Additionally, the wire is selected so as to have a thickness which, after the flattening process, will result in a metal blank having the desired thickness and width.

The invention is particularly applicable to a transfer system

After the preforming stage, the shaped wire or preform is then subjected to a flattening process to achieve a "blank" from which the desired product workpiece will be obtained via a stamping process. The term "wire" as used herein is not to be limited to wires having circular cross sections. Wires of other cross sections such as square, rectangular, etc can also be used. Further, the effective diameter of the wire can vary widely depending on the desired thickness of the metal part and the flattening process. The wire can be flattened by any typical process suitable for applying the requisite pressure to a piece of metal. For example, a shaped section of wire having an effective or nominal diameter of, for example, 3 to 50 mm, preferably 5 to 20 mm, can be flattened to a preformed piece of metal having a thickness of, for example, 1 to 30 mm, such as 1 to 25 mm or 8 to 30 mm, preferably 2 to 8 mm, by passage through a mechanical or hydraulic press that applies a pressure of, for example, 60 to 1000 tons, preferably 100 to 600 tons. The dimensions and tonnage listed above are merely provided as examples and are not intended to limit the invention.

Thus, the width and thickness of the blank are determined by the selection of the nominal diameter of the wire and the amount of pressure imposed during the flattening process. The length of the blank is determined primarily by the performing stage, by selecting the length of the wire and it's perform shape prior to the flattening step, although the flattening step will also influence the overall length of the blank.

This procedure, in which the blank is made from a flattened preformed wire, results in considerable savings in material costs as the blank obtained from the flattened preformed wire requires far less material than a conventional blank obtained from a metal sheet. In other words, in a conventional procedure blanks are cut and formed from a sheet of flat rolled metal. This procedure inherently imposes material costs due to the resultant scrap material. Yet, in the process according to the invention, the blank is formed with little or no material loss.

After the preform is converted into a blank, the blank can then be subjected to one or more further conventional metal stamping procedures. In such procedures, the blank can, for example, be "stamped" in a die and press arrangement such as in a mechanical or hydraulic press whereby excess material is trimmed from the blank to form a desired product workpiece, either a final product or an intermediate thereof. A typical metal stamping machine is a Minster® 200 ton mechanical press.

Additional cost savings can be achieved when the desired product workpiece is intended to be used as a skeleton within a molded plastic part. Take, for example, the case of a tilt lever for a steering column. If the lever is to be formed from metal (e.g., steel) with overmolded ends, this procedure requires additional trimming to produce shaved edges in order to stop flashing in the plastic mold and to provide an aesthetic appearance. These requirements add to the material cost of the lever as well as the manufacturing costs. If instead the lever is made entirely from plastic, the resultant product has a much higher potential for breakage.

To avoid these problems, the lever can instead be manufactured as a molded plastic part having a metal skeleton. This eliminates the costs associated with trimming the metal lever, and provides additional resistance to breakage in comparison to the plastic lever. But, when the skeleton is made by a traditional stamping process, there can still be an appreciable amount of material being trimmed from the blank to form the desired workpiece, i.e., the skeleton. By forming the blank from a flattened wire, the amount of scrap produced by stamping the desired workpiece can be significantly reduced.

BRIEF DESCRIPTION OF THE DRAWINGS

Various other features and attendant advantages of the present invention will be more fully appreciated as the same becomes better understood when considered in conjunction with the accompanying drawings, in which like reference characters designate the same or similar parts throughout the several views, and wherein.

DETAILED DESCRIPTION OF THE DRAWINGS

Figure 1:
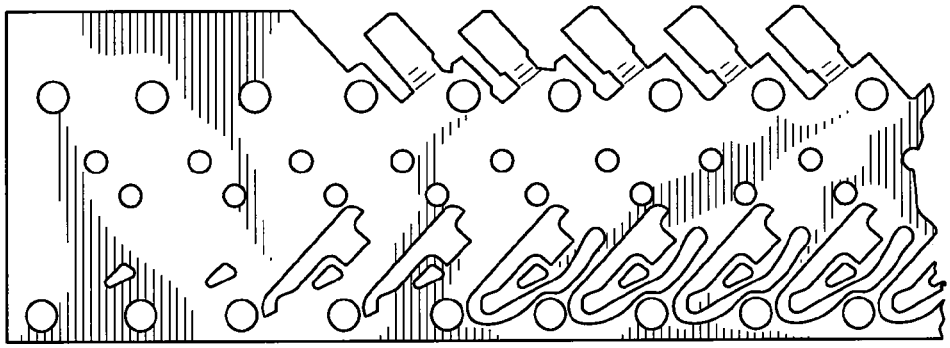
Prior Art FIG.1
FIG. 1 is a illustrates the production of a series of skeletons for a molded plastic tilt lever for the steering column of an automobile made by a progressive tool metal stamping process.

As shown in the photograph of FIG. 1, in accordance with known metal stamping procedures, a flat sheet of metal is subjected to a series of metal stamping processing steps to make a plurality of tilt lever skeletons, i.e., metal skeletons for plastic molded tilt levers for automobile steering columns. In this process, the flat metal sheet having a feed length of 2.0 inches, a width of 6.6 inches, and a thickness of 0.145 inches, is subjected to a series of metal stamping steps including piercing, cutting, forming, and blanking. As can be seen from FIG. 1, in this case the individual skeletons are not made from separate metal blanks but are all stamped from a common sheet of metal stock material connected together by a bottom strip of the feed sheet material. This process is known as a progressive tool metal stamping process, as opposed to a transfer process wherein the metal workpiece is move from one tooling station to the next by mechanical fingers. As can be seen from FIG. 1, the bottom strip of the sheet feed material used in the progressive tool metal stamping process is not subjected to metal stamping. Instead, it is used as a means to convey the material from one stamping step to the next. This unstamped bottom strip results in the production of scrap material thereby increasing material costs.

Figure 2A:
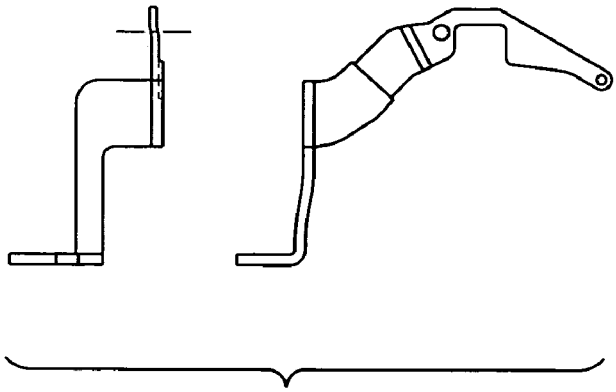
FIGS. 2A-2B are schematic drawings of the tilt lever skeleton from three different views.
Figure 2B:
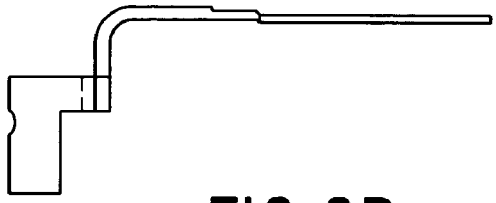
Figure 3:
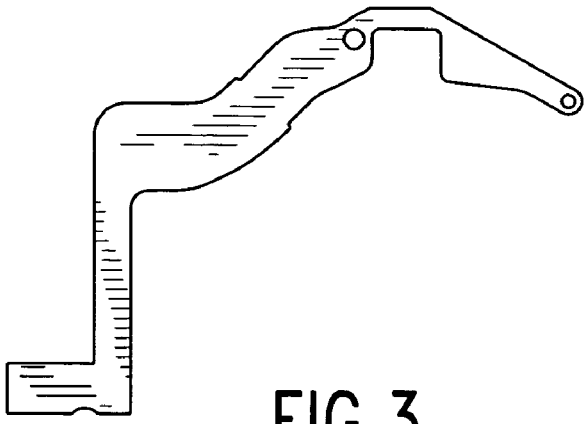
FIG. 3 is a drawing of the flat intermediate workpiece of the tilt lever skeleton illustrated in FIGS. 2A-2B.

The final tilt lever skeleton is illustrated in the FIGS. 2A-2B. In the course of making the skeleton, there is a flat intermediate workpiece made prior to the processing steps that result in the three dimensional structure illustrated in FIGS. 2A-2B. This flat intermediate workpiece is shown in FIG. 3.

Figure 4A:
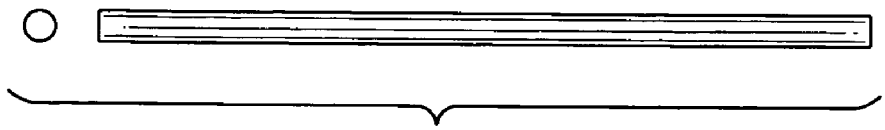
FIGS. 4A-4C illustrate the wire starting material, the preform for a tilt lever skeleton, and the flattened preform for a tilt lever skeleton, respectively, in accordance with the process according to the invention.
Figure 4B:
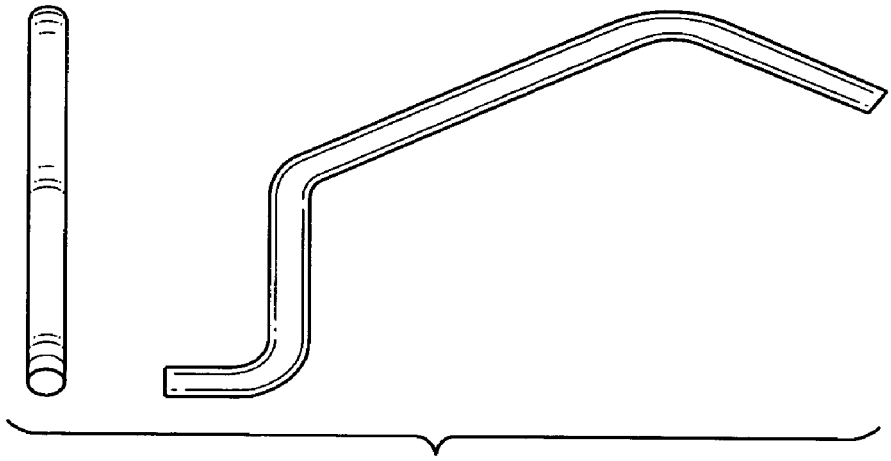
Figure 4C:
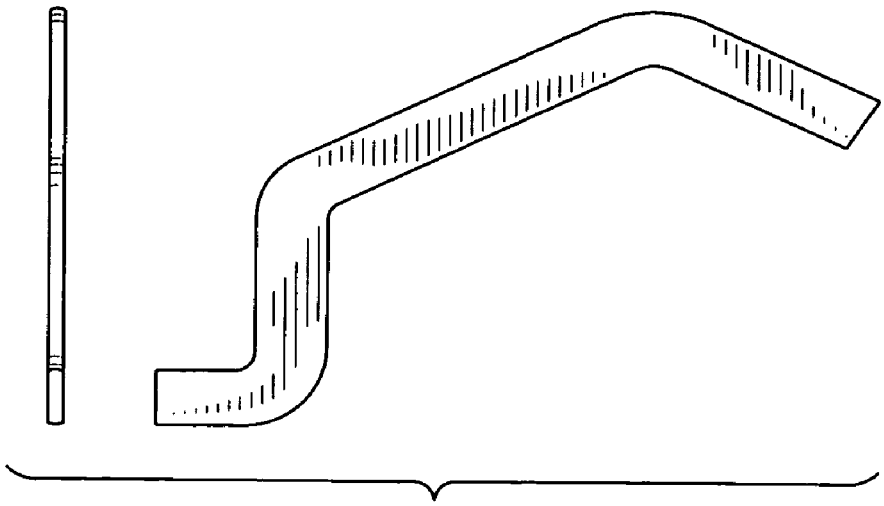

In the process according to the invention, a corresponding flat intermediate workpiece can be made by the following procedure. A wire having a length of 8⅜ inches and a diameter of ⅜ inches is cut from a spool of wire. See FIG. 4A. This wire is then shaped to correspond to the centerline of the finished tilt lever skeleton thereby forming a preform in accordance with the invention. See FIG. 4B. Thereafter, the preform is subjected to a pressure of, for example, 200 tons in a mechanical press to form a flattened preform. See FIG. 4C. This flattened perform is then used as a metal blank in a metal stamping process to obtain a flat intermediate workpiece for manufacturing a tilt level skeleton. See FIG. 5C.

Figure 5A:
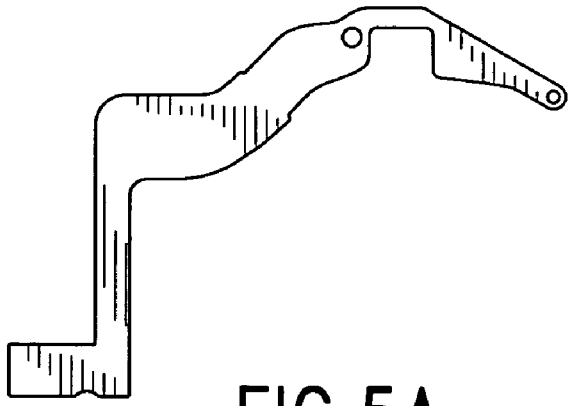
FIGS. 5A-5C illustrate, respectively, the flat intermediate workpiece of the tilt lever skeleton made by the prior art metal stamping process, a flattened preform intermediate made in accordance with the invention superimposed on top of the flat intermediate workpiece made by the prior art process, and a flat intermediate workpiece made in accordance with the invention.
Figure 5B:
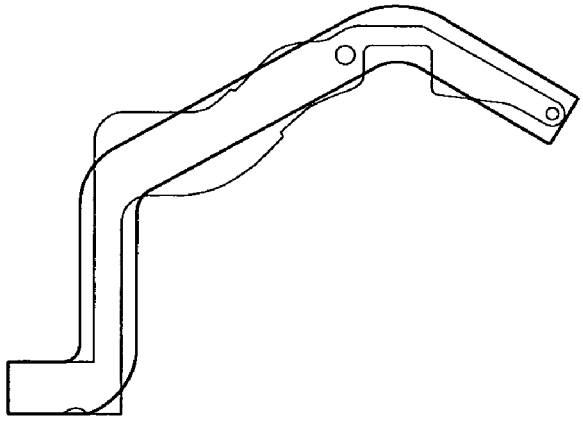
Figure 5C:
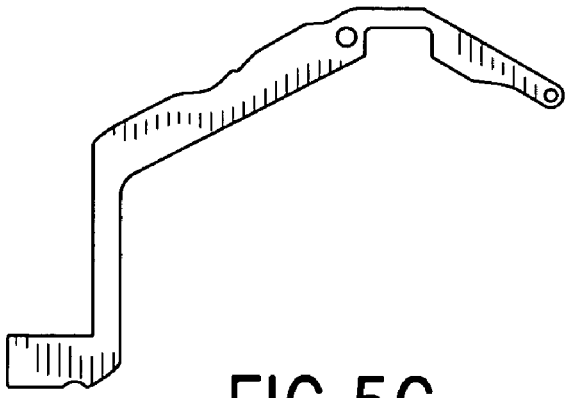

FIGS. 5A-5C provides a comparison of the flat intermediate workpiece made by the prior art metal stamping process (see FIG. 3 and FIG. 5A) and flat intermediate workpiece made by the process according to the invention (see FIG. 5C). As can be seen in FIG. 5B, the intermediate workpiece made by the process according to the invention fills substantially the outline of the flat intermediate workpiece made by the prior art process and thus is suitable as an intermediate for making the desired final product. As illustrated in FIG. 5B, the product of FIG. 5C differs slightly from the prior product shown in FIG. 5A, but the differences are not essential to the operation of the product. Further, these non-essential differences result in the use of less material thereby enhancing material cost savings. Alternatively, a larger diameter wire could be as the starting material and thus one could obtain the same shape as the prior art process.

The process according to the invention results in a tilt lever skeleton the manufacture of which requires little or no trimming. This leads to a substantial cost savings. For example, in one set of comparison runs, the process according to the invention required 182 lbs of starting material, whereas the prior art process required 590 lbs.

From the foregoing description, one skilled in the art can easily ascertain the essential characteristics of this invention and, without departing from the spirit and scope thereof, can make various changes and modifications of the invention to adapt it to various usages and conditions.

We claim:

1. A metal stamping process for forming a metal workpiece comprising:

preforming a piece of wire by bending the wire to have a shape corresponding to the 2-dimensional configuration of a desired product workpiece, wherein the wire is shaped to follow a centerline of the desired product workpiece, flattening said wire to form a metal blank, subjecting said metal blank to metal stamping to obtain the desired product workpiece.

2. A metal stamping process for forming a metal workpiece comprising:

subjecting a metal blank to metal stamping to obtain the desired product workpiece, wherein said blank is obtained by preforming a piece of wire by bending the wire to have a shape corresponding to the 2-dimensional configuration of a desired product workpiece, wherein the wire is shaped to follow a centerline of the desired product workpiece, and flattening the wire to form a metal blank.

3. A process according to claim 1, wherein said wire before being flattened has a diameter of 3 to 50 mm.

4. A process according to claim 3, wherein said wire before being flattened has a diameter of 3 to 50 mm.

5. A process according to claim 2, wherein said wire before being flattened has a diameter of 3 to 50 mm.

6. A process according to claim 1, wherein said blank formed after the wire is flattened has a thickness of 1 to 30 mm.

7. A process according to claim 6, wherein said blank formed after the wire is flattened has a thickness of 8 to 30 mm.

8. A process according to claim 7, wherein said blank formed after the wire is flattened has a thickness of 2 to 8 mm.

9. A process according to claim 2, wherein said blank formed after the wire is flattened has a thickness of 1 to 30 mm.

10. A process according to claim 1, wherein during the flattening of said wire the wire is subjected to a pressure of 60 to 1000 tons.

11. A process according to claim 10, wherein during the flattening of said wire the wire is subjected to a pressure of 60 to 100 tons.

12. A process according to claim 1, wherein said desired product workpiece is a skeleton placed in a plastic molded product.

13. A process according to claim 12, wherein said plastic molded product is a plastic molded tilt lever for a steering column.

14. A process according to claim 1, wherein said wire is made of aluminum, copper, zinc, steel, stainless steel, nickel, or titanium.

15. A process according to claim 14, wherein said wire is made of steel or stainless steel.

16. A process according to claim 1, wherein said workpiece has a length to width ratio of 1.5:1 to 10:1.

17. A process according to claim 16, wherein said workpiece has a length to width ratio of 2:1 to 5:1.

18. A stamped metal product prepared by the process according to claim 1.

19. A product according to claim 18, wherein said product workpiece is a skeleton placed in a plastic molded product.

* * * * *